US011168443B2

(12) United States Patent
Kallenberg

(10) Patent No.: US 11,168,443 B2
(45) Date of Patent: Nov. 9, 2021

(54) PAPER MACHINE CLOTHING DRAW-IN DEVICE AND USE OF SAME

(71) Applicant: VOITH PATENT GMBH, Heidenheim (DE)

(72) Inventor: Jens Kallenberg, Herbrechtingen (DE)

(73) Assignee: Voith Patent GmbH, Heidenheim (DE)

( * ) Notice: Subject to any disclaimer, the term of this patent is extended or adjusted under 35 U.S.C. 154(b) by 28 days.

(21) Appl. No.: 16/623,425

(22) PCT Filed: May 4, 2018

(86) PCT No.: PCT/EP2018/061471

§ 371 (c)(1),
(2) Date: Dec. 17, 2019

(87) PCT Pub. No.: WO2019/001806

PCT Pub. Date: Jan. 3, 2019

(65) Prior Publication Data

US 2020/0109513 A1 Apr. 9, 2020

(30) Foreign Application Priority Data

Jun. 27, 2017 (DE) ..... 20 2017 103 813.0

(51) Int. Cl.
*D21F 7/00* (2006.01)
*D21F 7/08* (2006.01)

(52) U.S. Cl.
CPC ..... *D21F 7/001* (2013.01); *D21F 7/08* (2013.01)

(58) Field of Classification Search
CPC combination set(s) only.
See application file for complete search history.

(56) References Cited

U.S. PATENT DOCUMENTS 6,398,915 B1 * 6/2002 Fargeout ..... D21F 7/001 162/273
2004/0094280 A1 5/2004 Gardner et al.
2007/0167100 A1 * 7/2007 Aldrich ..... D21F 7/001 442/327

FOREIGN PATENT DOCUMENTS

EP 1808529 A1 7/2007
EP 1820898 A1 8/2007
WO 0132981 A1 5/2001

* cited by examiner

*Primary Examiner* — Eric Hug
*Assistant Examiner* — Matthew M Eslami
(74) *Attorney, Agent, or Firm* — Laurence A. Greenberg; Werner H. Stemer; Ralph E. Locher

(57) ABSTRACT

A paper machine clothing draw-in device for drawing a paper machine clothing, in particular a drying screen, into a machine designed to produce and/or finish a material web, in particular a fibrous web, such as a paper, board or tissue web. The draw-in device includes a force-distributing element, which is designed to distribute a tensile force, which acts substantially at a point, substantially uniformly along a line. Here, the paper machine clothing draw-in device includes a plurality of such force-distributing elements, which are designed to become or to be connected to each other in normal use.

16 Claims, 5 Drawing Sheets

PAPER MACHINE CLOTHING DRAW-IN DEVICE AND USE OF SAME

BACKGROUND OF THE INVENTION

Field of the Invention

The present invention relates to a clothing draw-in device for drawing-in a clothing, in particular a drying screen, into a machine which is configured for producing and/or finishing a material web, in particular a fibrous web such as, for example, a paper, cardboard, or tissue web, comprising a force distribution element which is configured for distributing in a substantially uniform manner along a line a tensile force that engages in a substantially punctiform manner. The invention furthermore relates to the use of a clothing draw-in device of this type.

In the industrial production of paper, cardboard, or tissue, a fibrous suspension which is composed predominantly of water and has only a small proportion of fibers is supplied to an application unit, also referred to as the headbox, of a paper machine. The remaining part of the paper machine then substantially has the task of extracting the water from the fibrous suspension so as to generate the final product which can still be finished if required. To this end, the fibrous web formed from the fibrous suspension passes a plurality of sections in the paper machine, typically at least a forming section, a press section, and a drying section. Each section is usually assigned a dedicated clothing. Said clothings are also referred to as screens or felts. The clothings revolve continuously in the respective sections of the paper machine and thus transport the fibrous web continuously through the paper machine. The clothings herein are exposed to high wear and have to be regularly replaced.

If the clothing prior to the assembly thereof in the paper machine has already been closed to form a continuous belt, assembling is only possible from the side, that is to say in a machine cross direction. However, this requires complex measures in terms of the aisle layout. This can be avoided when the clothing is provided with an open seam joint which is closed only upon assembling. However, introducing the clothing in the machine direction is also not trivial since attention has to be paid to prevent creases making their way into the clothing when the latter is introduced. Clothings which are destined for the drying section of a paper machine, so-called drying screens, in particular often have an open seam joint so as to enable the drying screen to be drawn into the drying section. There is however the risk here in that creases in the screen are formed in the roller gaps of the drying section which render said screen unfit for use.

In order for the drawing-in of a clothing into a paper machine to be facilitated it is already known for a generic clothing draw-in device of the type mentioned at the outset to be used. Said clothing draw-in device can be embodied as a substantially triangular sheet, wherein a rope or a belt is fastened to one corner of the sheet, and the clothing to be drawn into the paper machine is fastened indirectly or directly to the opposite side. The rope, or the belt, respectively, in this instance can be guided through the roller gaps of the drying section, for example. When traction is supplied to the rope, or the belt, the tensile forces on account of the triangular shape of the sheet are distributed in a substantially uniform manner to the clothing which can thus be likewise guided through the roller gaps of the drying section without creases.

In the case of such a known clothing draw-in device it is disadvantageous that different sizes of the triangular sheets have to be produced for different paper machines, since the paper machines, and thus also the clothings to be introduced thereinto, have different widths. This renders the production of a single clothing draw-in device comparatively complex and costly.

SUMMARY OF THE INVENTION

It is an object of the present invention to provide a clothing draw-in device which at least does not have some of the afore-mentioned disadvantages, or has said disadvantages only to a minimized extent.

This object is achieved by a clothing draw-in device as claimed. Advantageous refinements of the invention are the subject matter of the dependent claims.

The clothing draw-in device according to the invention for drawing in a clothing, in particular a drying screen, into a machine which is configured for producing and/or finishing a material web, in particular a fibrous web such as, for example, paper, cardboard, or tissue web, in a manner known per se comprises a force distribution element which is configured for distributing in a substantially uniform manner along a line a tensile force that engages in a substantially punctiform manner. However, the clothing draw-in device according to the invention in comparison to a known clothing draw-in device is distinguished in that said clothing draw-in device according to the invention comprises a plurality of force distribution elements of this type which in the intended use are conceived to be connected to one another.

When the clothing draw-in device according to the invention comprises a plurality of force distribution elements, preferably two force distribution elements, which can be connected to one another it is possible for the clothing draw-in device to be used in a simple manner for clothings and paper machines of different widths. To this end, the force distribution elements have only to be connected to one another in a flexible manner.

In order to be able to distribute an overall tensile force across the plurality of force distribution elements without problems, it is proposed in a refinement of the invention that the clothing draw-in device furthermore comprises an overall tensile force distribution system which is configured for distributing an overall tensile force which is required for drawing the clothing into the machine to the individual force distribution elements, wherein the overall tensile force is preferably distributed in a substantially uniform manner to the individual force distribution elements, and wherein the proportional overall tensile force is preferably introduced in a substantially punctiform manner into each force distribution element.

It can be provided to this end that the overall tensile force distribution system comprises a plurality of rope-type elements, wherein one end of the rope-type elements is in each case connected, or connectable, to one of the force distribution elements, and wherein the respective other ends of the rope-type elements are preferably connected, or connectable, to one another. The overall tensile force can thus be directed into the clothing draw-in device according to the invention at a single location, said clothing draw-in device according to the invention then reliably transmitting the overall tensile force in a substantially uniform manner to the clothing. "Rope-type elements" herein does not only refer to ropes but also to belts, straps, and the like.

As is already known in practice and has proven successful therein, at least one force distribution element, preferably all force distribution elements, in the case of the clothing draw-in device according to the invention can have a substantially triangular basic shape, wherein the force distribution element is configured for distributing a tensile force engaging in a punctiform manner at a corner of the substantially triangular force distribution element in a substantially uniform manner along a side of the substantially triangular force distribution element that is opposite said corner.

It has been demonstrated to be particularly advantageous when the side that is opposite the corner at which a tensile force in the intended use engages in a substantially punctiform manner on the substantially triangular force distribution element has a dimension which is between 4 m and 7 m, preferably between 5 m and 6 m, furthermore preferably approximately 5.5 m. On account thereof, clothing widths which are suitable for almost all comparatively large paper machines can thus be covered using only two force distribution elements. In the case of comparatively small paper machines it can however be preferable for the dimension of the respective side to be between 2 m and 4 m, preferably between 2.5 m and 3.5 m.

With a view to an ideally uniform distribution of force it is advantageous for the basic shape of the force distribution element to correspond to an isosceles triangle, preferably even a substantially equilateral triangle.

In order for the clothing draw-in device according to the invention to be set to the required width it is advantageous when an overlapping portion of a first force distribution element in the intended use of the clothing draw-in device overlaps in a planar manner an overlapping portion of a second force distribution element. The overlapping portion of the first force distribution element and the overlapping portion of the second force distribution element herein can have a substantially triangular shape.

The first and the second force distribution element herein are preferably configured in such a manner that the overlapping portions are capable of being set to dissimilar sizes, wherein the size setting can be performed in a stepless or stepped manner.

In experiments for connecting the force distribution elements it has proven particularly simple and rapid for the force distribution elements in the intended use to be configured to be connected to one another by means of a hook-and-loop fastener. At the same time, the hook-and-loop fastener has proven sufficiently stable in withstanding tensile forces which are to be applied to the clothing to be introduced. The term "hook-and-loop fastener" herein is understood to be a reversible quick-release closure in which two surfaces can be brought to bear on one another, wherein the one surface is provided with a multiplicity of small barbs, and the other surface has a multiplicity of small loops or the like in which the barbs can engage. Textile hook-and-loop fasteners are in particular marketed by the Velcro® company.

In order to avoid any formation of creases in the clothing in a particularly reliable manner, it is proposed that at least one force distribution element, preferably all force distribution elements, comprises/comprise at least one, preferably rod-type, reinforcement element which extends preferably along or at least so as to be parallel with the line along which the tensile force that engages in a substantially punctiform manner is distributed in a substantially uniform manner by the force distribution element.

For the same purpose it is advantageous for the force distribution elements in the intended use to be configured for being connected to one another in such a manner that the respective lines thereof along which the tensile force that engages in a substantially punctiform manner is distributed in a substantially uniform manner by the force distribution element are approximately in mutual alignment.

In a manner similar to the already known clothing draw-in devices it is preferable also here for at least one force distribution element, preferably all force distribution elements, to be formed predominantly from a textile material. In order for high tensile forces to also be able to be received it is very particularly preferable for the textile material to be Kevlar®.

A further aspect of the present invention relates to the use of a clothing draw-in device as described above for drawing a clothing, in particular a drying screen, into a machine which is configured for producing and/or finishing a material web, in particular a fibrous web such as, for example, a paper, cardboard, or tissue web. According to the invention, at least two force distribution elements herein are connected to one another in such a manner that the overall dimension of the mutually connected force distribution elements in the machine cross direction corresponds substantially to the dimension in the machine cross direction of the clothing to be introduced into the machine. "Substantially" in this context means that the dimensions do not have to be exactly congruent. In particular, the clothing to be introduced into the paper machine in the machine cross direction can have a larger dimension than the clothing draw-in device according to the invention, or than the force distribution elements of the latter, respectively. Experiments have thus demonstrated that said clothing can be larger by between 100 mm and 800 mm, preferably between 200 mm and 700 mm, without the substantially uniform transmission of the tensile forces to the clothing being negatively impacted, or creases being formed when introducing the clothing into the paper machine.

It is furthermore proposed that the clothing draw-in device is connected to the clothing to be drawn into the machine, and the clothing is drawn into the machine, wherein an overall tensile force required to this end by way of the clothing draw-in device is applied to the clothing to be drawn in, and wherein the overall tensile force by means of the clothing draw-in device is distributed to the clothing to be drawn in in a substantially uniform manner across the dimension in the machine cross direction of the clothing to be drawn in.

It is to be noted that clothing draw-in devices are in particular required always when a machine is fitted with a clothing for the first time, or when a clothing has previously torn. The use of a clothing draw-in device can otherwise be dispensed with in certain circumstances. In such a case, the old clothing to be replaced can indeed be cut open, and the new clothing to be drawn into the machine can be fastened to said old clothing. The new clothing can thus be introduced into the machine simultaneously with pulling out the old clothing, without a clothing draw-in device being required.

BRIEF DESCRIPTION OF THE SEVERAL VIEWS OF THE DRAWING

The invention will be further explained hereunder by means of schematic drawings which are not to scale and in which.

DESCRIPTION OF THE INVENTION

Figure 1:
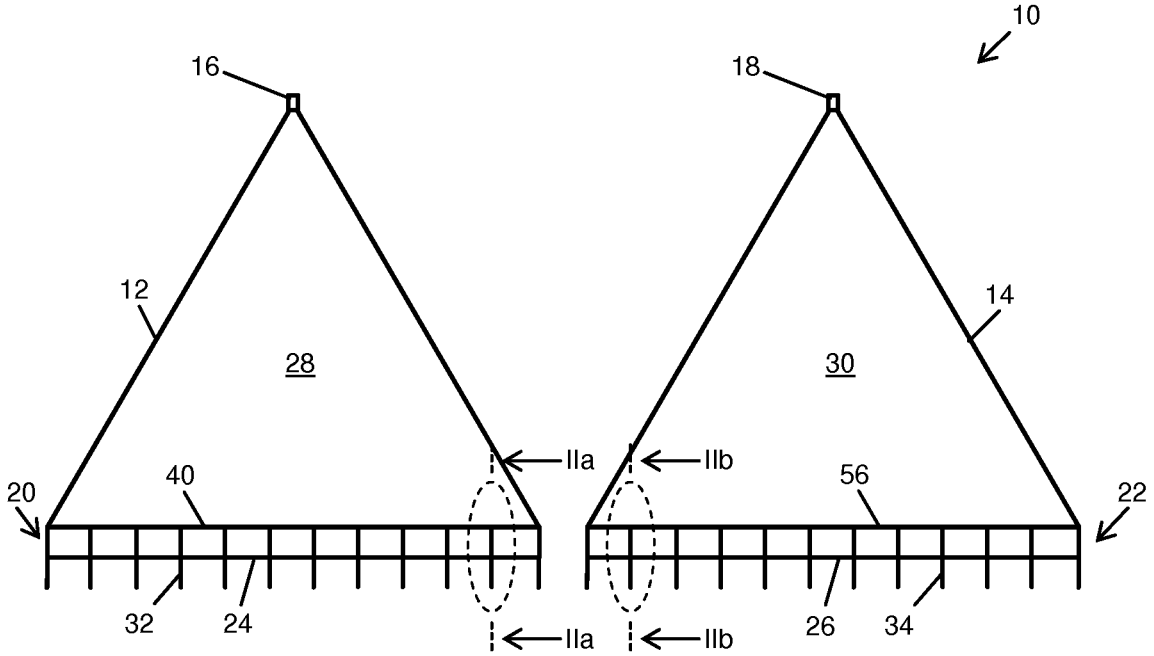
FIG. 1 shows an illustration of two not yet mutually connected force distribution elements of a clothing draw-in device according to the invention.

Two force distribution elements 12, 14 of a clothing draw-in device 10 according to the invention are schematically shown in FIG. 1. In this illustration the two force distribution elements 12, 14 are shown so as not yet to be connected to one another. The two force distribution elements 12, 14 have a substantially triangular basic shape, wherein the substantially triangular basic shape here corresponds substantially to an equilateral triangle. The two force distribution elements 12, 14 at the tip thereof illustrated at the top in FIG. 1 have in each case one force introduction device 16, 18, for example in the form of a tab, so as to be able to direct a tensile force preferably into the respective force distribution element 12, 14. The substantially triangular force distribution elements 12, 14 on the side thereof that is opposite the force introduction device 16, 18 have in each case one rectangular fastening portion 20, 22. To this extent it becomes evident that "substantially triangular" does not mean that the force distribution elements 12, 14 are configured so as to be exactly triangular. The two fastening portions 20, 22 have in each case one fastening lateral periphery 24, 26 that is opposite the force introduction device 16, 18. The two force distribution elements 12, 14 are configured substantially from a textile material 28, 30, in particular a tarpaulin-type or sheet-type material. In order for a tensile force that in the intended use engages on the respective force introduction device 16, 18 thereof in a substantially punctiform manner to be able to be distributed in a substantially uniform manner along a line, preferably along the fastening lateral periphery 24, 26, the force distribution elements 12, 14 are preferably formed substantially from a hard-wearing material such as, for example, Kevlar®. The force distribution elements 12, 14 herein can be formed from individual webs of the material which are connected, in particular sewn, to one another. The textile material 28, 30 can be configured in multiple tiers in particular in the region of the respective tip of the substantially triangular force distribution elements 12, 14 at which the force introduction device 16, 18 is provided. For example, a web of the textile material 28, 30 can be folded back on itself in this region so as to form at least a two-tier and/or three-tier portion. The textile materials 28, 30 of the two force distribution elements 12, 14 are preferably identical.

As can furthermore be seen in the schematic illustration of FIG. 1, a plurality of fastening strips 32, or 34, respectively, which extend beyond the fastening lateral periphery 24, 26 are in each case attached to the fastening portions 20, 22. The fastening strips 32, or 34, respectively, herein preferably run so as to be orthogonal to the fastening lateral periphery 24, 26. For reasons of clarity, only one of the fastening strips 32, 34 per force distribution element 12, 14 is in each case provided with a reference sign in FIG. 1. The fastening strips 32, 34 herein are distributed uniformly along the fastening lateral periphery 24, 26. Both force distribution elements 12, 14 have the same number of fastening strips 32, 34. In the present exemplary embodiment, these are in each case 12 fastening strips which therebetween have a spacing of 0.5 m. Each force distribution element 12, 14 thus has an overall width of 5.5 m. The present invention is however not limited in any way to said values.

Figure 2A:
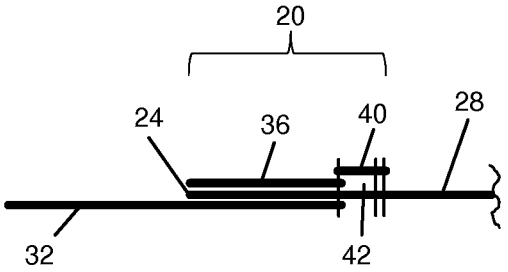
FIG. 2*a* shows a sectional view along the section plane IIa-IIa indicated in FIG. 1.
Figure 2B:
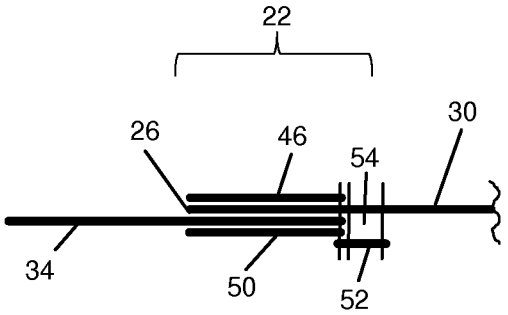
FIG. 2*b* shows a sectional view along the section plane IIb-IIb indicated in FIG. 1.

While it is indeed possible for the two force distribution elements 12, 14 be configured so as to be completely identical with one another, it can however be advantageous during production, in particular for reasons of material savings, for the two force distribution elements 12, 14 in terms of the construction thereof to at least slightly differ from one another, as is the case in the present exemplary embodiment. This can be seen, for example, in the schematic sectional views of FIGS. 2*a* and 2*b*, wherein FIG. 2*a* shows a sectional view along the section line IIa-IIa on the left force distribution element 12 in FIG. 1, and FIG. 2*b* shows a sectional view along the section line IIb-IIb on the right force distribution element 30 in FIG. 1. In principle, it would also be conceivable for force distribution elements of dissimilar sizes to be used.

A portion of the textile material 28 from which the left force distribution element 12 in FIG. 1 is substantially formed can be seen in FIG. 2*a*. The textile material 28 is in particular shown in the region of the fastening portion 20 that extends up to the fastening lateral periphery 24. The fastening strip 32 is fastened to the textile material 28 at the bottom in FIG. 2*a*. The fastening strip 32 on the surface thereof that points upward in FIG. 2*a* has a multiplicity of loops or the like for configuring a hook-and-loop connection. Furthermore, a first hook-and-loop strip 36 which on the surface thereof that points upward in FIG. 2*a* has a multiplicity of barbs for configuring a hook-and-loop connection is attached in the fastening portion 20 to the side of the textile material 28 that is opposite the fastening strip 32.

Figure 6A:
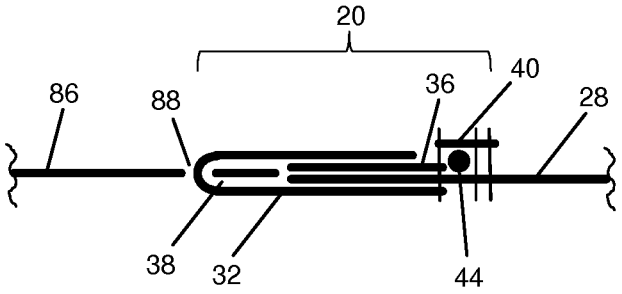
FIG. 6*a* shows a sectional view along the section plane VIa-VIa indicated in FIG. 5.

As is shown in FIG. 6*a*, which will yet be discussed in more detail hereunder, the fastening strip 32, where the two force distribution elements 12, 14 do not overlap, can be bent back by 180° while configuring a first fastening tab 38, wherein the loops or the like of the fastening strip 32, while configuring a hook-and-loop connection, come into contact with the barbs of the first hook-and-loop strip 36.

A second hook-and-loop strip 40 is furthermore fastened to the same side of the textile material 28 to which the first hook-and-loop strip 36 is fastened. Like the first hook-and-loop strip 36, the second hook-and-loop strip 40 for configuring a hook-and-loop connection also has a multiplicity of barbs that point upward in FIG. 2*a*. The second hook-and-loop strip 40 herein slightly overlaps the first hook-and-loop strip 36. By contrast to the first hook-and-loop strip 36 main however, the direction of main extent of the second hook-and-loop strip 40 does not run so as to be orthogonal to the fastening lateral periphery 24, that is to say from left to right in FIG. 2*a*, but so as to be parallel with the fastening lateral periphery 24, that is to say into the image plane of FIG. 2*a*, as can be readily seen in FIG. 1.

Furthermore, three seams by way of which the second hook-and-loop strip 40 is fastened to the textile material 28 are indicated in FIG. 2*a* by three vertically extending lines. Like the second hook-and-loop strip 40, the three seams herein run so as to be parallel with the fastening lateral periphery 24, thus into the image plane of FIG. 2*a*. The seam on the extreme left in FIG. 2*a* herein has an obviously larger spacing from the directly adjacent seam thereto, that is to say from the central seam, than the seam on the extreme right in FIG. 2*a*. A first duct 42 is thus formed between the seam on the extreme left in FIG. 2*a* and the central seam, as well as between the second hook-and-loop strip 40 and the textile material 28, said first duct 42 extending so as to be parallel with the fastening lateral periphery 24. A first reinforcement element 44 such as is shown, for example, in FIG. 6*a* and which serves for reliably avoiding any formation of creases in the force distribution element 12 during the intended use can be introduced into the first duct 42. The first reinforcement element 44 preferably has a rod-type shape, furthermore preferably having a circular or flattened, for example oval, cross section. The first reinforcement element 44 herein can be a glass fiber rod.

A portion of the textile material 30 from which the right force distribution element 14 in FIG. 1 is substantially formed can be seen in FIG. 2*b*. The textile material 30 is in particular shown in the region of the fastening portion 22 that extends up to the fastening lateral periphery 26. The fastening strip 34 is attached to the textile material 30 at the bottom in FIG. 2*b*. The fastening strip 34 on the surface thereof that points upward in FIG. 2*b* has a multiplicity of loops or the like for configuring a hook-and-loop connection. Furthermore, a third hook-and-loop strip 46 which on the surface thereof that points upward in FIG. 2*b* has a multiplicity of barbs for configuring a hook-and-loop connection is attached in the fastening portion 22 to the side of the textile material 30 that is opposite the fastening strip 34.

Figure 6B:
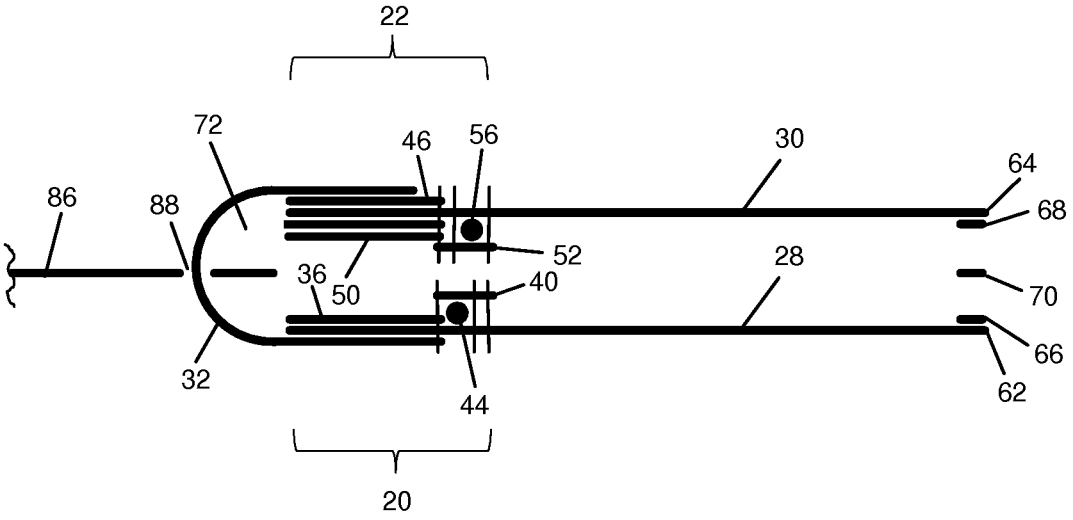
FIG. 6*b* shows a sectional view along the section plane VIb-VIb indicated in FIG. 5.
Figure 6C:
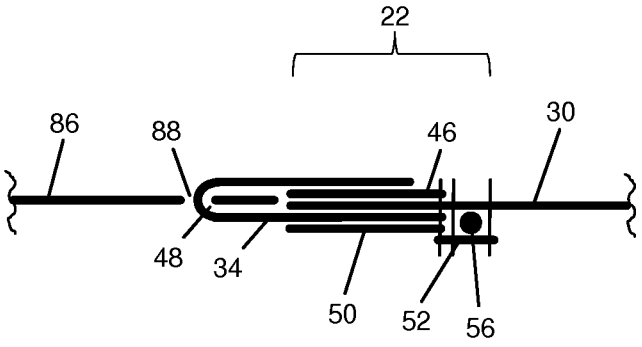
FIG. 6*c* shows a sectional view along the section plane VIc-VIc indicated in FIG. 5.

As is shown in FIG. 6*c*, which will yet be discussed in more detail hereunder, the fastening strip 34, where the two force distribution elements 12, 14 do not overlap, can be bent back by 180° while configuring a second fastening tab 48, wherein the loops or the like of the fastening strip 34, while configuring a hook-and-loop connection, come into contact with the barbs of the third hook-and-loop strip 46.

Furthermore, a fourth hook-and-loop strip 50 is fastened to the same side of the textile material 30 to which the fastening strip 34 is fastened, wherein the fourth hook-and-loop strip 50 bears in a planar manner on the surface of the fastening strip 34 that faces away from the textile material 30 and does not protrude beyond the fastening strip 34. The fourth hook-and-loop strip 50 is configured so as to be shorter than the fastening strip 34 and ends at the fastening lateral periphery 26. The fourth hook-and-loop strip 50 on the surface thereof that points downward in FIG. 2*b* has a multiplicity of loops or the like for configuring a hook-and-loop connection.

Moreover, a fifth hook-and-loop strip 52 is fastened to the textile material 30 on the side of the textile material 30 that is opposite the third hook-and-loop strip 46. Like the fourth hook-and-loop strip 50, the fifth hook-and-loop strip 52 for configuring a hook-and-loop connection also has a multiplicity of loops or the like that point downward in FIG. 2*b*. The fifth hook-and-loop strip 52 herein slightly overlaps the fourth hook-and-loop strip 50 and the fastening strip 34. By contrast to the fourth hook-and-loop strip 50, the direction of main extent of the fifth hook-and-loop strip 52 does not run so as to be orthogonal to the fastening lateral periphery 26, that is to say from left to right in FIG. 2*b*, but so as to be parallel with the fastening lateral periphery 26, that is to say into the image plane of FIG. 2*b*, as can be readily seen in FIG. 1.

Furthermore, three seams by which the fifth hook-and-loop strip 52 is fastened to the textile material 30 are indicated by three vertically extending lines in FIG. 2*b*. Like the fifth hook-and-loop strip 52, the three seams herein run so as to be parallel with the fastening lateral periphery 26, thus into the image plane of FIG. 2*b*. The seam on the extreme right in FIG. 2*b* herein has an obviously larger spacing from the directly adjacent seam thereto, that is to say from the central seam, than the seam on the extreme left in FIG. 2*b*. A second duct 54 is thus formed between the seam on the extreme right in FIG. 2*b* and the central seam, as well as between the fifth hook-and-loop strip 52 and the textile material 30, said second duct 54 extending so as to be parallel with the fastening lateral periphery 26. A second reinforcement element 56, as is shown for example in FIG. 6*c*, which serves for reliably avoiding a formation of creases in the force distribution element 14 during the intended use can be introduced into the second duct 54. The second reinforcement element 56 preferably has a rod-type shape, further preferably having a circular or flattened, for example oval, cross section. The second reinforcement element 56 can be a glass fiber rod.

Figure 3:
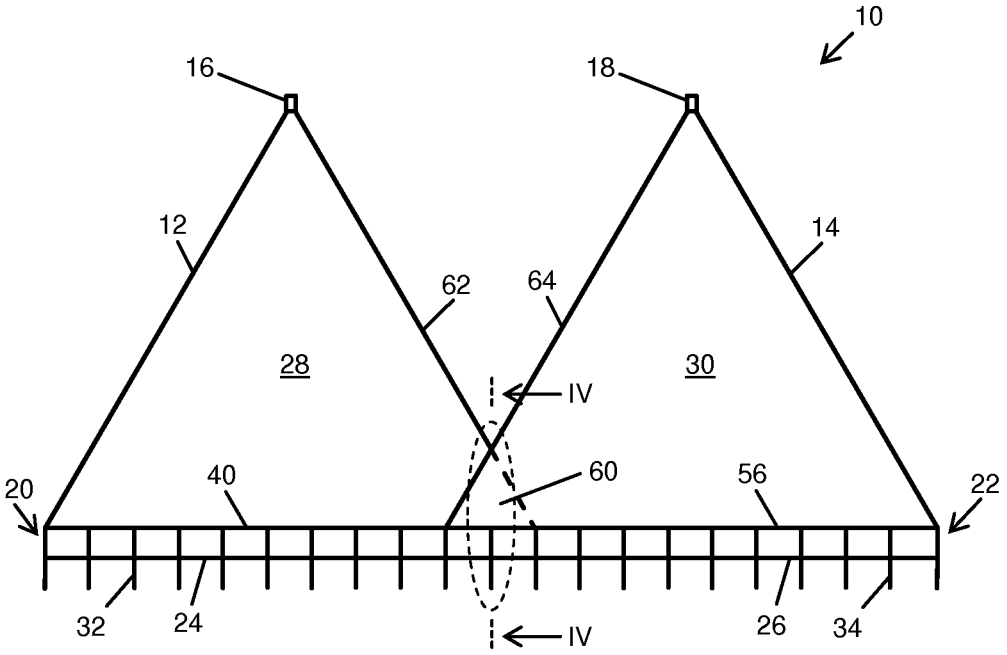
FIG. 3 shows an illustration of the two force distribution elements shown in FIG. 1, said force distribution elements in this instance however being connected to one another, specifically according to a first specific application.

FIG. 3 shows a schematic illustration of the two force distribution elements 12, 14 shown in FIG. 1, said force distribution elements 12, 14 however this time being connected to one another, and specifically according to a first specific application. To this end, the force distribution element 14 on the right in FIG. 1 has been placed onto the force distribution element 12 on the left in FIG. 1, specifically in such a manner that the fastening strip 34 of the right force distribution element 14 on the extreme left in FIG. 1 comes to lie exactly on the third fastening strip 32 from the right in FIG. 1 of the left force distribution element 12. In the same manner, the second fastening strip 34 from the left in FIG. 1 of the right force distribution element 14 comes to lie on the second fastening strip 32 from the right in FIG. 1 of the left force distribution element 12, and the third fastening strip 34 from the left in FIG. 1 of the right force distribution element 14 comes to lie on the fastening strip 32 on the extreme right in FIG. 1 of the left force distribution element 12. The two fastening lateral peripheries 24, 26 thus are in mutual alignment. The force distribution element 14 illustrated on the right in the figures thus in portions overlaps the force distribution element 12 illustrated on the left in the figures. The portions of the two force distribution elements 12, 14 which mutually overlap can also be referred to as overlapping portions 58, 60, wherein only the overlapping portion 60 of the force distribution element 14 lying on the top can be seen in FIG. 3. The two overlapping portions 58, 60 have a substantially triangular basic shape.

Reference hereunder is made to the lateral peripheries of the two substantially triangular force distribution elements 12, 14 which can be assigned to the overlapping portions 58, 60 as the overlapping lateral peripheries 62, 64, wherein the lateral periphery on the right in FIG. 3 of the left force distribution element 12 is the overlapping lateral periphery 62, and the left lateral periphery of the right force distribution element 14 is the overlapping lateral periphery 64. For improved visualization, the portion of the overlapping lateral periphery 62 of the left force distribution element 12 which is overlapped by the right force distribution element 14 is illustrated in dashed lines in FIG. 3.

Figure 4:
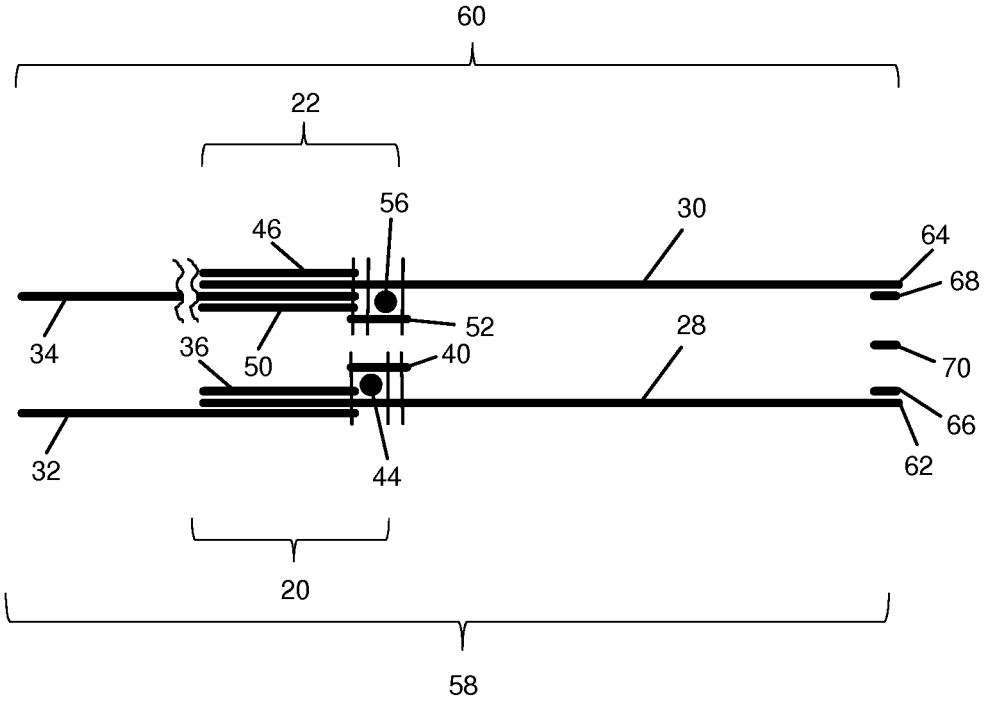
FIG. 4 shows a sectional view along the section plane IV-IV indicated in FIG. 3.

FIG. 4 shows a schematic lateral view through the section plane IV-IV indicated in FIG. 3. First, the portions of the fastening strips 34 of the force distribution element 14 lying on the top in the overlapping portion 60, to the extent that said portions protrude beyond the fastening portion 22, are severed, in particular cut off, this being schematically indicated in FIG. 4. Subsequently the loops or the like on the downward-pointing surfaces of the fourth hook-and-loop strip 50, and of the fifth hook-and-loop strip 52, of the upper force distribution element 14, respectively, in FIG. 4 for configuring a hook-and-loop connection can be brought into contact with the barbs on the upward-pointing surfaces of the first hook-and-loop strip 36 and of the second hook-and-loop strip 40 in FIG. 4.

In order for the connection of the upper force distribution element 14 to the lower force distribution element 12 to be further improved with a view to the intended use, it is proposed that the two overlapping lateral peripheries 62, 64 at the intersection point thereof are connected to one another, preferably likewise by means of a hook-and-loop connection. To this end, as is indicated in FIG. 4, a sixth hook-and-loop strip 66 on the upward-pointing surface of the textile material 28 of the lower force distribution element 12 in FIG. 4 can extend along the overlapping lateral periphery 62 and be connected to the textile material 28. The sixth hook-and-loop strip 66 on the surface thereof that points upward in FIG. 4 herein has a multiplicity of loops or the like for configuring a hook-and-loop connection. In a similar manner, a seventh hook-and-loop strip 68 on the downward-pointing surface of the textile material 30 of the upper force distribution element 14 in FIG. 4 can extend along the overlapping lateral periphery 64 and be connected to the textile material 30. The seventh hook-and-loop strip 68 on the surface thereof that points downward in FIG. 4 herein has a multiplicity of loops or the like for configuring a hook-and-loop connection. The clothing draw-in device 10 according to the invention can furthermore comprise a hook-and-loop connection piece 70 which is configured so as to be substantially diamond-shaped and in terms of the dimension thereof corresponds precisely to the dimensions of the portion in which the sixth hook-and-loop strip 66 and the seventh hook-and-loop strip 68 mutually overlap. The hook-and-loop connection piece 70 on the surface thereof that points upward in FIG. 4, as well as on the surface thereof that points downward in FIG. 4, has a multiplicity of barbs for configuring a hook-and-loop connection. The additional connection of the lower force distribution element 12 to the upper force distribution element 14 is established in that the hook-and-loop connection piece 70 is positioned therebetween exactly at the location where the sixth hook-and-loop strip 66 and the seventh hook-and-loop strip 68 mutually overlap, and the two force distribution elements 12, 14 are pressed against one another in order for a double hook-and-loop connection to be configured at this location.

As is shown in FIG. 6*b* which will yet be discussed in more detail hereunder, the fastening strip 32, where the two force distribution elements 12, 14 overlap, can be bent by 180° while configuring a third fastening tab 72, wherein the loops or the like of the fastening strip 32 of the lower force distribution element 12, while configuring a hook-and-loop connection, come into contact with the barbs of the third hook-and-loop strip 48 of the upper force distribution element 14.

Figure 5:
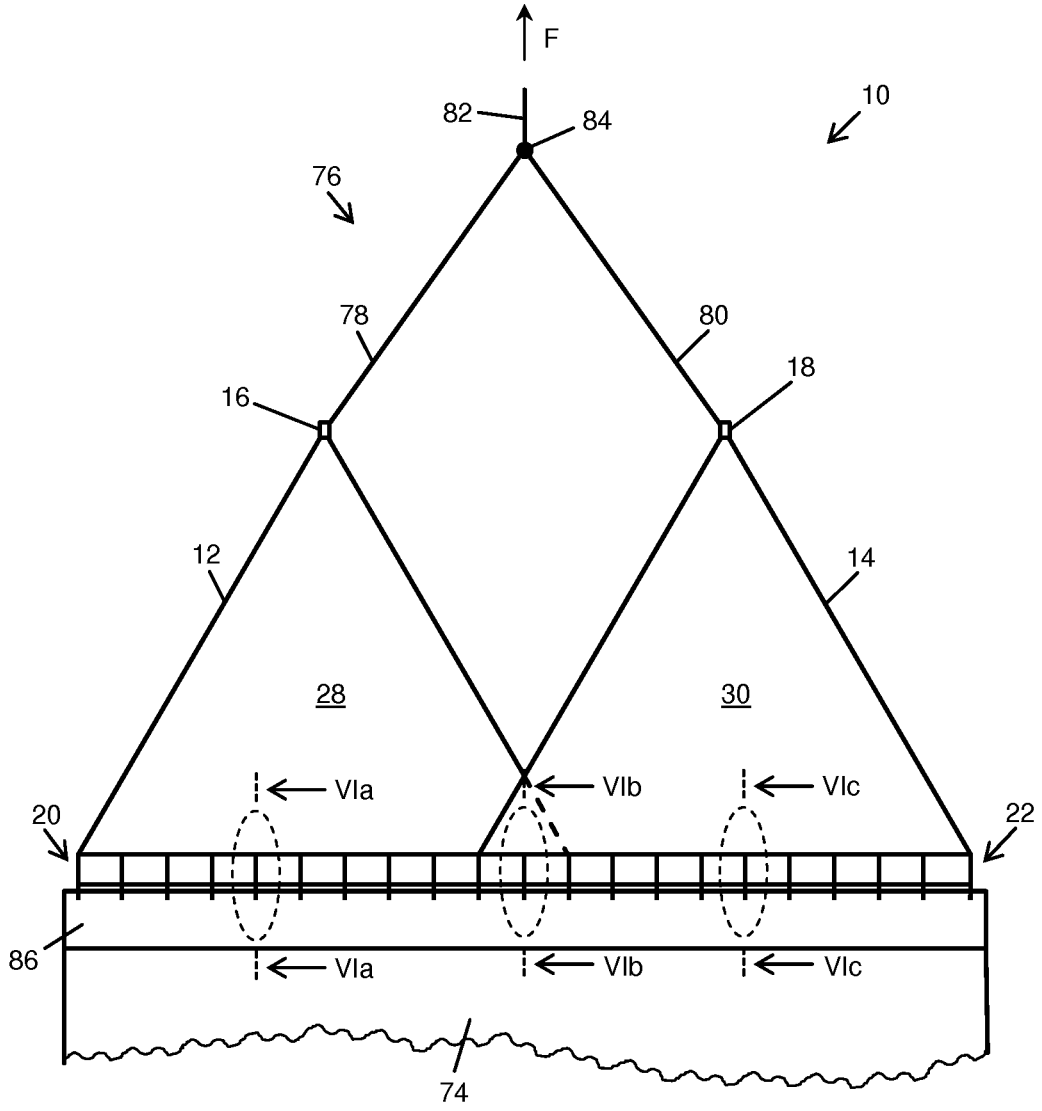
FIG. 5 shows an illustration similar to that of FIG. 3, here however supplemented by further elements of the clothing draw-in device according to the invention and a portion of the clothing to be drawn into the machine.

FIG. 5 shows a schematic illustration similar to that of FIG. 3, this time however supplemented by further elements of the clothing draw-in device 10 according to the invention and a portion of the clothing 74 which is to be drawn into the machine and which can in particular be a drying screen. The clothing draw-in device 10 shown in FIG. 5 in comparison to the illustration in FIG. 3 is supplemented by an overall tensile force distribution system 76. The overall tensile force distribution system 76 comprises two rope-type elements 78, 80 which are preferably configured in the form of a belt and preferably are of substantially identical lengths. A longitudinal end of the rope-type element 78 on the left in FIG. 5 is connected to the force introduction device 16 of the force distribution element 12 on the left in FIG. 5, while a longitudinal end of the rope-type element 80 on the right in FIG. 5 is connected to the force introduction device 18 of the force distribution element 14 on the right in FIG. 5. The respective opposite longitudinal ends of the two rope-type elements 78, 80 are connected to one another in a force concentration point 84. The longitudinal end of a further rope-type element 82 can likewise be connected to the force concentration point 84. The overall tensile force distribution system 76 serves for distributing an overall tensile force F, by way of which pulling is exerted on the further rope-type element 82, in a substantially uniform manner to the further rope-type element 78, 80 which, by way of the force introduction devices 16, 18 of the two force distribution elements 12, 14, then introduce in each case substantially half the overall tensile force F in a substantially punctiform manner into said force distribution elements 12, 14.

Besides the clothing draw-in device 10 according to the invention, a connection piece 86 that is configured so as to be substantially rectangular is also illustrated in FIG. 5. The connection piece 86 in the width direction preferably has the same dimension as the clothing 74 to be drawn into the machine. The connection piece 86 is furthermore preferably formed from the same material as the clothing 74 to be drawn into the machine. For example, the connection piece 86 can be a piece of waste of the clothing 74 which was produced in the production of said clothing 74. The dimension in the width direction of the connection piece 86 herein is slightly larger than the overall dimension in the width direction of the two force distribution elements 12, 14 that are connected to one another according to FIGS. 3 and 5, or the two force distribution elements 12, 14 have been connected to one another such that the overall dimension thereof in the width direction, that is to say in the machine cross direction, is slightly smaller than the dimension in the width direction of the connection piece 86, or of the clothing 74 to be drawn into the machine. The connection piece 86, or the clothing 74, respectively, in the width direction preferably protrudes over the two mutually connected force distribution elements 12, 14 by the same dimension on both sides. Experiments have demonstrated that the connection piece 86, or the clothing 74 to be drawn into the machine, respectively, can preferably between be between 100 mm and 800 mm, furthermore preferably between 200 mm and 700 mm, larger than the overall dimension of the two mutually connected force distribution elements 12, 14 without the substantially uniform transmission of the tensile forces to the clothing 74 being negatively impacted, or creases being formed when introducing the clothing 74 into the machine.

In order for the two force distribution elements 12, 14 to be connected to the connection piece 86, a plurality of short slots 88 are incorporated in the latter, wherein the slots 88 in terms of the number and dimension thereof in the width direction correspond to the number, or dimension, respectively, in the width direction of the fastening strips 32, 34 of the two force distribution elements 12, 14. In other words, each remaining fastening strip 32, 34, that is to say each fastening strip 32, 34 that has not been cut off, of the two mutually connected force distribution elements 12, 14 according to FIGS. 3 and 5 is assigned exactly one slot 88. Three of the slots 88 can be seen in an exemplary manner in the schematic sectional views of FIGS. 6*a*, 6*b*, and 6*c*, which have been taken along the section planes VIa-VIa, VIb-VIb, and VIc-VIc, respectively, in FIG. 5. A fastening strip 32 of the left force distribution element 12 in FIGS. 3 and 5 is in each case guided through one of the slots 88 in FIGS. 6*a* and 6*b*, whereas a fastening strip 34 of the right force distribution element 14 in FIGS. 3 and 5 is guided through one of the slots 88 in FIG. 6*c*. Portions of the connection piece 86 are thus received in the first, second, and third fastening tabs 38, 48, 72 that are formed by the fastening strips 32, 34 bent back by 180°. The connection piece 86 for the intended use is thus fixedly connected to the two mutually connected force distribution elements 12, 14, wherein the tensile force that has in each case been introduced into the two force distribution elements 12, 14 by way of the force introduction device thereof in a substantially punctiform manner can be transmitted so as to be distributed across the entire width of the connection piece 86. The connection piece 86 which is preferably formed from the same material as the clothing to be drawn into the machine, can be connected to the clothing 74 in a relatively simple temporary manner known per se, that is to say so as to be connectable and re-releasable in a simple manner. Only a small portion of the clothing 74 is indicated in FIG. 5. On account of the connection piece, an even higher degree of homogenization of the overall tensile force F across the clothing 74 to be drawn into the machine arises. Once the clothing 74, in particular a drying screen, has been introduced into the paper machine by means of the clothing draw-in device 10 according to the invention, the clothing draw-in device 10 is again separated from the clothing 74, and the latter for the intended use thereof is closed by a seam so as to form a continuous screen web.

The particular feature of the clothing draw-in device 10 according to the invention in comparison to clothing draw-in devices known from the prior art lies in the high flexibility of said clothing draw-in device 10 according to the invention in terms of the use thereof for clothings, or paper machines, respectively, of different widths, that is to say dimensions in the machine cross direction. In the case of the first specific application shown in FIG. 5, the width of the clothing 74 to be drawn in is, for example, somewhat more than 10.0 m, for example 10.4 m, wherein a total of 21 fastening strips 32, 34 which are mutually spaced apart by in each case 0.5 m are used on the two force distribution elements 12, 14. Depending on how the two force distribution elements 12, 14 are mutually overlapped, it is however possible for clothings having a width between somewhat more than 5.5 m and somewhat more than 10.5 m to be drawn into machines without having to make modified force distribution elements 12, 14 which form the main component part of the clothing draw-in device 10 according to the invention for this purpose. If a clothing of a width of somewhat more than 5.5 m is to be drawn into a paper machine, it suffices for only one of the two force distribution elements 12, 14 to be used. However, if the clothing be drawn in, or the corresponding paper machine, respectively, is wider than somewhat more than 5.5 m, the two force distribution elements 12, 14 can be connected to one another, wherein the overall width thereof can be increased in a step-by-step manner, in this exemplary embodiment in steps of in each case 0.5 m until the maximum width is reached, said maximum width in this exemplary embodiment being 10.5 m. In the case of the maximum width of the two mutually connected force distribution elements 12, 14 the width of the overlapping portions 58, 60 is minimal, that is to say approximately 0.5 M in this exemplary embodiment.

Figure 7:
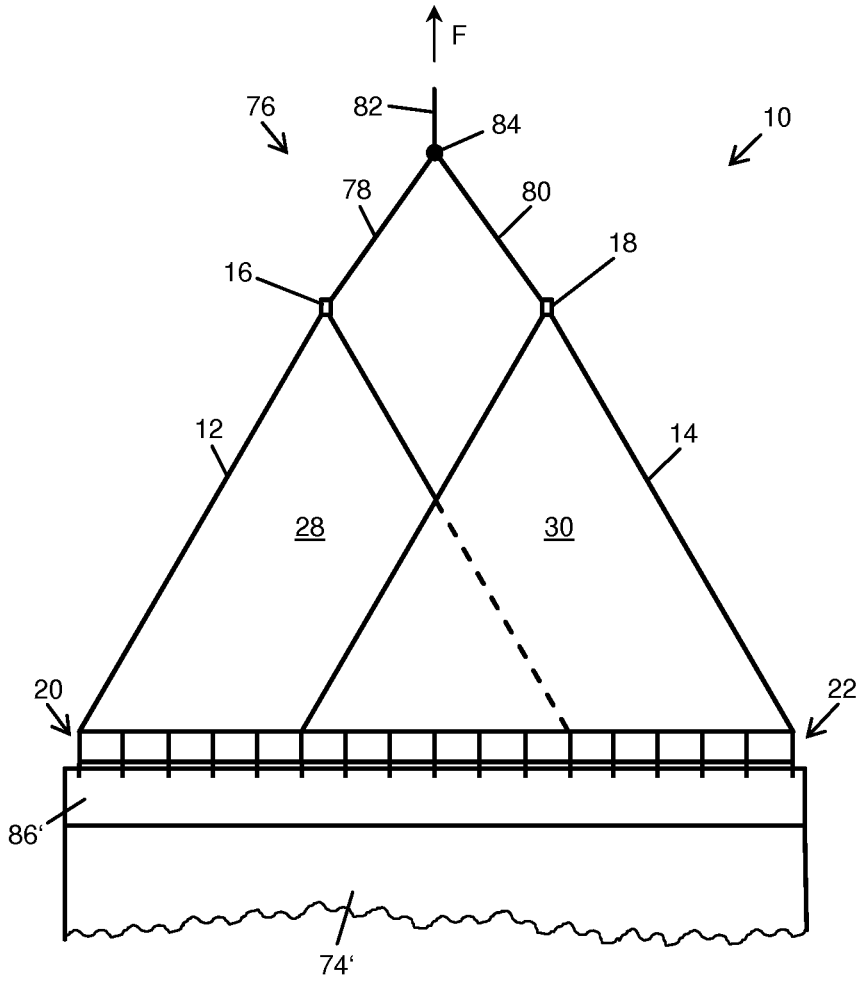
FIG. 7 shows an illustration similar to that of FIG. 5, wherein the two force distribution elements are however connected to one another for a second specific application.

A second specific application in which the same force distribution elements 12, 14 as used in the case of the first specific application are used is illustrated for improved visualization of the present invention in FIG. 7. However, since the clothing 74' to be drawn into the machine in the second specific application is narrower than in the first specific application, the two force distribution elements 12, 14 are brought to overlap to a greater extent. In the second specific application, seven fastening strips 32 of the first force distribution element 12 are brought to mutually overlap with seven fastening strips 34 of the second force distribution element 14, respectively. The overlapping portions thus have a width of 3.0 m, and the overall width of the two interconnected force distribution elements 12, 14 is 5.5 m+5.5 m−3.0 m=8.0 m. On account thereof, the clothing draw-in device 10 according to the invention is adapted in an optimal manner to the width of the clothing 74' in the second specific application, said width here being 8.3 m. A connection piece 86' in the second specific application is again formed from the same material as the clothing 74' to be drawn into the machine, and also has the same width as said clothing 74'. The clothing draw-in device in the second specific application otherwise functions in a manner analogous to that in the first specific application, which is why reference to this extent is made to the explanations above.

It is to be noted in general that not only the second hook-and-loop strip 40 and the fifth hook-and-loop strip 52, the seams thereof being explicitly illustrated in the figures, are sewn to the textile material 28, 30 of the respective force distribution element 12, 14 assigned thereto, but that all previously described hook-and-loop strips can of course also be sown to the textile material 28, 30 of the force distribution element 12, 14 assigned thereto. The reason for the seams used for fastening the second hook-and-loop strip 40 and the fifth hook-and-loop strip 52 being explicitly illustrated lies in highlighting where the first duct 42 and the second duct 44 which serve for receiving the first reinforcement element 44 and the second reinforcement element 56, respectively, are precisely disposed.

As can be seen in FIG. 6*b*, the first duct 42 and the second duct 44 are disposed such that the reinforcement elements 44, 56 disposed therein, in the intended use of the clothing draw-in device 10 according to the invention, do not come to lie directly on top of one another but in the sectional view according to FIG. 6 are disposed so as to be laterally mutually offset. An excessive local thickening of the clothing draw-in device 10 according to the invention thus does not arise, this otherwise being potentially critical when the clothing draw-in device 10 is guided through roller gaps, for example.

It is furthermore to be noted in general that the concept of the disposal of barbs and loops, or the like, described above for configuring hook-and-loop connections could of course also be implemented in the reversed order to that described above. In other words, where barbs are disposed according to the previous description, loops or the like could be disposed, and vice versa. The concept described above is however preferable since the barbs are typically configured so as to be stiffer than the loops or the like, such that the surfaces provided with the barbs when guided without being covered through the roller gaps of the screen section, for example, would tend to be more easily damaged, or could cause damage to the rollers. By contrast, this is not critical in the case of the surfaces provided with loops or the like. In the case of the concept described above it is possible to at least largely ensure that all surfaces provided with barbs are covered in the intended use.

While it is conceivable for the force distribution elements 12, 14 to be designed such that the overall width thereof can be continuously varied in the connected state, the previously described concept in which a modification is possible only in a step-by-step manner is however preferable. On account of this concept it can specifically be at least largely ensured that no surfaces provided with barbs remain uncovered, on the one hand. On the other hand, the previously described concept can also be implemented by way of a manageable material input and thus in a cost-effective manner. Since the clothings to be drawn into the machine can anyway be configured so as to be wider than the two mutually connected force distribution elements 12, 14 within a specific tolerance range, the step-by-step adjustability is usually entirely sufficient in practice.

As has been described above, by way of the two force distribution elements 12, 14 of the exemplary embodiment shown it is possible for clothings having a width between somewhat more than 5.5 m and somewhat more than 10.5 m to be drawn into machines without having to make modified force distribution elements 12, 14 which form the main component part of the clothing draw-in device 10 according to the invention for this purpose. This in practice is sufficient for the majority of the paper machines existing today. However, should clothings have to be drawn into wider paper machines, the present concept by way of minor adapting can be modified with a view to the use of three more force distribution elements, as can be readily seen by the person skilled in the art. In the case of three force distribution elements, one left, one central, and one right force distribution element would accordingly be used, said force distribution elements for the intended use being connected to one another, or being connectable to one another, respectively, so that the required overall width is achieved.

LIST OF REFERENCE SIGNS

10 Clothing draw-in device
12, 14 Force distribution element
16, 18 Force introduction device
20, 22 Fastening portion
24, 26 Fastening lateral periphery
28, 30 Textile material
32, 34 Fastening strip
36 First hook-and-loop strip
38 First fastening tab
40 Second hook-and-loop strip
42 First duct
44 First reinforcement element
46 Third hook-and-loop strip
48 Second fastening tab
50 Fourth hook-and-loop strip
52 Fifth hook-and-loop strip
54 Second duct
56 Second reinforcement element
58, 60 Overlapping portion
62, 64 Overlapping lateral periphery
66 Sixth hook-and-loop strip
68 Seventh hook-and-loop strip
70 Hook-and-loop connection piece
72 Third fastening tab
74, 74' Clothing
76 Overall tensile force distribution system
78, 80 Rope-type element
82 Further rope-type element
84 Force concentration point
86, 86' Connection piece
88 Slot
F Overall tensile force

The invention claimed is:

1. A clothing draw-in device for drawing-in a clothing into a material web-producing or finishing machine, the clothing draw-in device comprising:

a plurality of force distribution elements, each of said force distribution elements having a first end and an opposite, second end and being configured to distribute a tensile force that acts on said first end in a substantially punctiform manner uniformly at said second end along a line that extends at said second end substantially orthogonally to the tensile force;

said plurality of force distribution elements including a first force distribution element and a second force distribution element being configured to be connected to one another and to form the draw-in device having said first and second force distribution elements next to one another;

wherein the lines of said plurality of force distribution elements that extend at said second end of each of said first and second force distribution element are coextensive along a common line extending substantially orthogonally to a tensile force that acts in a substantially punctiform manner on the clothing draw-in device via said plurality of force distribution elements; and wherein said first and second force distribution elements overlap one another with a planar overlap portion having a variable width along said common line, defining a width of the clothing draw-in device that is variable and renders the clothing draw-in device functional for clothings of different widths in a machine cross direction.

2. The clothing draw-in device according to claim 1, further comprising an overall tensile force distribution system configured for distributing an overall tensile force which is required for drawing the clothing into the machine to the individual said force distribution elements, wherein the overall tensile force is distributed substantially uniformly to the individual said force distribution elements, and wherein a proportional overall tensile force is introduced in a substantially punctiform manner into each of said force distribution elements.

3. The clothing draw-in device according to claim 2, wherein said overall tensile force distribution system comprises a plurality of rope elements each having a first end connectable one of said force distribution elements, and a second end connectable one another.

4. The clothing draw-in device according to claim 1, wherein at least one of said force distribution elements has a substantially triangular basic shape and is configured for distributing the tensile force engaging in a punctiform manner at a corner of the substantially triangular said force distribution element in a substantially uniform manner along a side that is opposite said corner.

5. The clothing draw-in device according to claim 4, wherein each of said force distribution elements has a substantially triangular shape.

6. The clothing draw-in device according to claim 4, wherein the side that is opposite said corner at which the tensile force engages on said substantially triangular force distribution element has a variable length dimension between 4 m and 7 m.

7. The clothing draw-in device according to claim 4, wherein the side that is opposite said corner at which the tensile force engages on said substantially triangular force distribution element has a variable length dimension between 2 m and 4 m.

8. The clothing draw-in device according to claim 4, wherein the basic shape of said at least one force distribution element corresponds to an isosceles triangle.

9. The clothing draw-in device according to claim 1, wherein the overlapping portion of the first force distribution element and the overlapping portion of the second force distribution element have a triangular shape.

10. The clothing draw-in device according to claim 1, wherein the first and second force distribution elements are configured so that the overlapping portions are enabled to be set to dissimilar sizes.

11. The clothing draw-in device according to claim 1, wherein said force distribution elements are configured to be connected to one another by hook-and-loop fasteners.

12. The clothing draw-in device according to claim 1, wherein at least one of said plurality of force distribution elements comprises at least one reinforcement element which extends parallel with the line along which the tensile force is distributed substantially uniformly by said force distribution element.

13. The clothing draw-in device according to claim 12, wherein each of said force distribution elements comprise a reinforcement element being a rod.

14. The clothing draw-in device according to claim 1, wherein at least one of said force distribution elements is formed from a textile material.

15. A method of drawing a clothing into a machine for producing and/or finishing a material web, the method comprising: providing a clothing draw-in device according to claim 1; and connecting at least two force distribution elements to one another such that an overall dimension of the mutually connected force distribution elements in a machine cross direction along the common line corresponds substantially to a dimension in the machine cross direction of the clothing to be drawn into the machine.

16. The method according to claim 15, which comprises:

connecting the clothing draw-in device to the clothing to be drawn into the machine and drawing the clothing into the machine;

applying an overall tensile force required for drawing in the clothing by way of the clothing draw-in device to the clothing, and thereby distributing the overall tensile force to the clothing substantially uniformly across the dimension in the machine cross direction of the clothing to be drawn in.

* * * * *